US008936115B2

(12) United States Patent
Bellin

(10) Patent No.: US 8,936,115 B2
(45) **Date of Patent: *Jan. 20, 2015**

(54) PCD CUTTER WITH FINS AND METHODS FOR FABRICATING THE SAME

(75) Inventor: Federico Bellin, Pau (FR)

(73) Assignee: Varel Europe S.A.S., Pau (FR)

( * ) Notice: Subject to any disclaimer, the term of this patent is extended or adjusted under 35 U.S.C. 154(b) by 519 days.

This patent is subject to a terminal disclaimer.

(21) Appl. No.: 12/862,531

(22) Filed: Aug. 24, 2010

(65) Prior Publication Data

US 2012/0048626 A1 Mar. 1, 2012

(51) Int. Cl.

| | |
|---|---|
| ***E21B 10/46*** | (2006.01) |
| ***B21K 5/04*** | (2006.01) |
| ***E21B 10/573*** | (2006.01) |
| ***E21B 10/567*** | (2006.01) |

(52) U.S. Cl.

CPC ..... *E21B 10/5676* (2013.01); *E21B 10/5735* (2013.01)

USPC ..... 175/426; 175/430; 175/434; 76/108.2

(58) Field of Classification Search

USPC ..... 175/426, 430, 434; 76/108.2

See application file for complete search history.

(56) References Cited

U.S. PATENT DOCUMENTS

| | | | |
|---|---|---|---|
| 4,592,433 | A | 6/1986 | Dennis |
| 4,784,023 | A | 11/1988 | Dennis |
| 4,984,642 | A | 1/1991 | Renard et al. |
| 5,120,327 | A | 6/1992 | Dennis |
| 6,258,139 | B1 | 7/2001 | Jensen |
| 6,488,106 | B1 | 12/2002 | Dourfaye |
| 6,527,069 | B1 | 3/2003 | Meiners et al. |
| 7,316,279 | B2 | 1/2008 | Wiseman et al. |
| 7,517,589 | B2 | 4/2009 | Eyre |
| 7,712,553 | B2 | 5/2010 | Shamburger |
| 7,762,359 | B1 | 7/2010 | Miess |
| 2005/0247492 | A1 | 11/2005 | Shen et al. |
| 2006/0032677 | A1 | 2/2006 | Azar et al. |
| 2006/0102389 | A1 | 5/2006 | Wiseman et al. |
| 2006/0278442 | A1 | 12/2006 | Kristensen |
| 2007/0278017 | A1* | 12/2007 | Shen et al. ..... 175/426 |
| 2009/0152016 | A1 | 6/2009 | Eyre et al. |
| 2009/0313908 | A1 | 12/2009 | Zhang et al. |
| 2011/0031036 | A1 | 2/2011 | Patel |

OTHER PUBLICATIONS

Lee W. Young, International Search Report and Written Opinion—PCT/US2011/048599, Jan. 18, 2012, 8 pages, ISA/US Commissioner for Patents, Alexandria, Virginia.

Lee W. Young, International Search Report and Written Opinion—PCT/US2011/048604, Jan. 18, 2012, 8 pages, ISA/US Commissioner for Patents, Alexandria, Virginia.

* cited by examiner

*Primary Examiner* — Catherine Loikith

(74) *Attorney, Agent, or Firm* — King & Spalding LLP

(57) ABSTRACT

A cutting table includes a cutting surface, an opposing surface, a cutting table outer wall, and one or more fins. The cutting table outer wall extends from the circumference of the opposing surface to the circumference of the cutting surface. The fins extend from a portion of the cutting surface to a portion of the cutting table outer wall. The cutting table is optionally leached prior to forming the fins. One or more fins are positioned in parallel with at least another fin in some embodiments. In some embodiments, the fins are positioned circumferentially around the cutting surface. In some embodiments, the cutting table is coupled to a substrate to form a cutter. The fins are formed either after or during the formation of the cutting table.

41 Claims, 5 Drawing Sheets

PCD CUTTER WITH FINS AND METHODS FOR FABRICATING THE SAME

RELATED APPLICATIONS

The present application is related to U.S. patent application Ser. No. 12/862,401, entitled "Functionally Leached PCD Cutter" and filed on Aug. 24, 2010, which is hereby incorporated by reference.

TECHNICAL FIELD

The present invention relates generally to polycrystalline diamond compact ("PDC") cutters; and more particularly, to PDC cutters having one or more fins.

BACKGROUND

Polycrystalline diamond compacts ("PDC") have been used in industrial applications, including rock drilling applications and metal machining applications. Such compacts have demonstrated advantages over some other types of cutting elements, such as better wear resistance and impact resistance. The PDC can be formed by sintering individual diamond particles together under the high pressure and high temperature ("HPHT") conditions referred to as the "diamond stable region," which is typically above forty kilobars and between 1,200 degrees Celsius and 2,000 degrees Celsius, in the presence of a catalyst/solvent which promotes diamond-diamond bonding. Some examples of catalyst/solvents for sintered diamond compacts are cobalt, nickel, iron, and other Group VIII metals. PDCs usually have a diamond content greater than seventy percent by volume, with about eighty percent to about ninety-five percent being typical. An unbacked PDC can be mechanically bonded to a tool (not shown), according to one example. Alternatively, the PDC can be bonded to a substrate, thereby forming a PDC cutter, which is typically insertable within a downhole tool (not shown), such as a drill bit or a reamer.

FIG. 1 shows a cross-sectional view of a PDC cutter 100 having a polycrystalline diamond ("PCD") cutting table 110, or compact, in accordance with the prior art. Although a PCD cutting table 110 is described in the exemplary embodiment, other types of cutting tables, including cubic boron nitride ("CBN") compacts, are used in alternative types of cutters. Referring to FIG. 1, the PDC cutter 100 typically includes the PCD cutting table 110 and a substrate 150 that is coupled to the PCD cutting table 110. The PCD cutting table 110 is about one hundred thousandths of an inch (2.5 millimeters) thick in the thickest portions of the PCD cutting table 110; however, this thickness can vary depending upon the application.

The substrate 150 includes a top surface 152, a bottom surface 154, and a substrate outer wall 156 that extends from the circumference of the top surface 152 to the circumference of the bottom surface 154. The top surface 152 is non-planar, but can be substantially planar in certain embodiments. The non-planar top surface 152 includes one or more columns 153 that extend substantially upwards in a vertical direction with respect to the bottom surface 154. However, in other embodiments, the non-planar top surface 152 includes bump and valleys or any other protrusions and/or indentations thereby making the top surface 152 non-planar. The PCD cutting table 110 includes a cutting surface 112, an opposing surface 114, and a PCD cutting table outer wall 116 that extends from the circumference of the cutting surface 112 to the circumference of the opposing surface 114. According to some exemplary embodiments, a bevel (not shown) is formed around at least the circumference of the PCD cutting table 110. The opposing surface 114 is non-planar and complementary to the top surface 152, but can be substantially planar in certain embodiments. The opposing surface 114 of the PCD cutting table 110 is coupled to the top surface 152 of the substrate 150 and surrounds the columns 153, or other protrusion types. Typically, the PCD cutting table 110 is coupled to the substrate 150 using a HPHT press. However, other methods known to people having ordinary skill in the art can be used to couple the PCD cutting table 110 to the substrate 150. In one embodiment, upon coupling the PCD cutting table 110 to the substrate 150, the cutting surface 112 of the PCD cutting table 110 is substantially parallel to the bottom surface 154 of the substrate 150. Additionally, the PDC cutter 100 has been illustrated as having a right circular cylindrical shape; however, the PDC cutter 100 is shaped into other geometric or non-geometric shapes in other embodiments.

According to one example, the PDC cutter 100 is formed by independently forming the PCD cutting table 110 and the substrate 150, and thereafter bonding the PCD cutting table 110 to the substrate 150. Alternatively, the substrate 150 is initially formed and the PCD cutting table 110 is then formed on the top surface 152 of the substrate 150 by placing polycrystalline diamond powder onto the top surface 152, including around the columns 153, and subjecting the polycrystalline diamond powder and the substrate 150 to a high temperature and high pressure process. Although two methods of forming the PDC cutter 100 have been briefly mentioned, other methods known to people having ordinary skill in the art can be used.

According to one example, the PCD cutting table 110 is bonded to the substrate 150, formed from a material such as cemented tungsten carbide, by subjecting a layer of diamond powder and a mixture of tungsten carbide and cobalt powders to HPHT conditions. The cobalt diffuses into the diamond powder during processing and therefore acts as both a catalyst/solvent for the sintering of the diamond powder to form diamond-diamond bonds and as a binder for the tungsten carbide. Voids are formed between the carbon-carbon bonds of the diamond. Strong bonds are formed between the PCD cutting table 110 and the cemented tungsten carbide substrate 150. The diffusion of cobalt into the diamond powder results in cobalt being deposited within the voids formed within the PCD cutting table 110. Although some materials, such as tungsten carbide and cobalt, have been provided as examples, other materials known to people having ordinary skill in the art can be used to form the substrate 150, the PCD cutting table 110, and form bonds between the substrate 150 and the PCD cutting table 110.

Since the cobalt, or catalyst material, is deposited within the voids formed within the PCD cutting table 110 and cobalt has a much higher thermal expansion rate than diamond, the PCD cutting table 110 becomes thermally degraded at temperatures above about 750 degrees Celsius and its cutting efficiency deteriorates significantly. Hence, typical leaching processes, which are known to people having ordinary skill in the art, have been used to react the deposited catalyst material, thereby removing the catalyst material from the voids.

All typical leaching processes involve the presence of an acid solution (not shown) which reacts with the catalyst material that is deposited within the voids of the PCD cutting table 110. According to one example of a typical leaching process, the PDC cutter is placed within an acid solution (not shown) such that at least a portion of the PCD cutting table 110 is submerged within the acid solution. The acid solution reacts with the catalyst material along the outer surfaces of the PCD cutting table 110. The acid solution slowly moves inwardly within the interior of the PCD cutting table 110 and continues to react with the catalyst material. However, as the acid solution moves further inwards, the reaction byproducts become increasingly more difficult to remove; and hence, the rate of leaching slows down considerably. For this reason, a tradeoff occurs between leaching process duration, wherein costs increase as the leaching duration increases, and catalyst removal depth. Typically, the leaching process is performed to allow a catalyst removal depth of about two millimeters; however, this depth can be increased or decreased depending upon the application of the PCD cutting table 110 and/or the cost constraints.

FIG. 2A shows a cross-sectional view of the PDC cutter 100 of FIG. 1 having a wear flat 210 in the PCD cutting table 110 in accordance with the prior art. FIG. 2B shows a side elevational view of the PDC cutter 100 of FIG. 2A in accordance with the prior art. Referring to FIGS. 2A and 2B, the wear flat 210 develops on a portion of the circumference of the PCD cutting table 110 when the portion of the PCD cutting table 110 is worn out by the interaction occurring between the PCD cutting table 110 and the rock formation. When the wear flat 210 is formed, eventually at least a portion of one or more columns 153 of the substrate 150 becomes exposed for cutting the rock formation. An interface 220 is formed within the wear flat 210 where the PCD cutting table 110 meets with the column 153. Since the PCD cutting table 110 is formed substantially from diamond or other known material, and the columns 153 are formed substantially from tungsten carbide or other known material, the interaction occurring between the PCD cutting table 110 and the rock formation and between the column 153 and the rock formation causes the column 153 to wear faster than the surrounding PCD cutting table 110. Thus, the exposed portion of the column 153 becomes slightly recessed into the wear flat 210 when compared to the exposed portion of the PCD cutting table 110 within the wear flat 210. Hence, the PDC cutter 100 provides for a claw cutting action occurring between the interfaces 220 and the rock formation in addition to the cutting actions performed individually by the PCD cutting table 110 and the columns 153. This cutting action provides for improved cutting and a higher rate of penetration ("ROP"). Typically, the worn PDC cutter 110 or the entire downhole tool that includes several of these worn PDC cutters 110 are replaced once the columns 153 become exposed or soon thereafter; thereby having the benefits of the claw cutting action not being fully realized.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
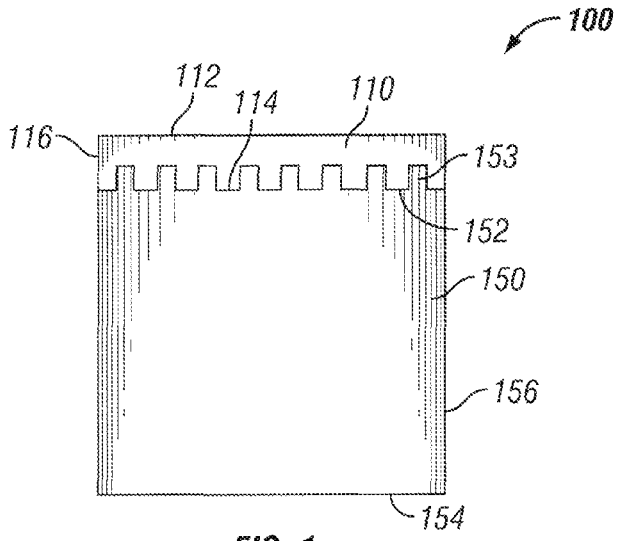
FIG. 1 (Prior Art)
FIG. 1 shows a cross-sectional view of a PDC cutter having a PCD cutting table in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed generally to polycrystalline diamond compact ("PDC") cutters; and more particularly, to PDC cutters having one or more fins. Although the description of exemplary embodiments is provided below in conjunction with a PDC cutter, alternate embodiments of the invention may be applicable to other types of cutters or compacts including, but not limited to, polycrystalline boron nitride ("PCBN") cutters or PCBN compacts. The invention is better understood by reading the following description of non-limiting, exemplary embodiments with reference to the attached drawings, wherein like parts of each of the figures are identified by like reference characters, and which are briefly described as follows.

Figure 3A:
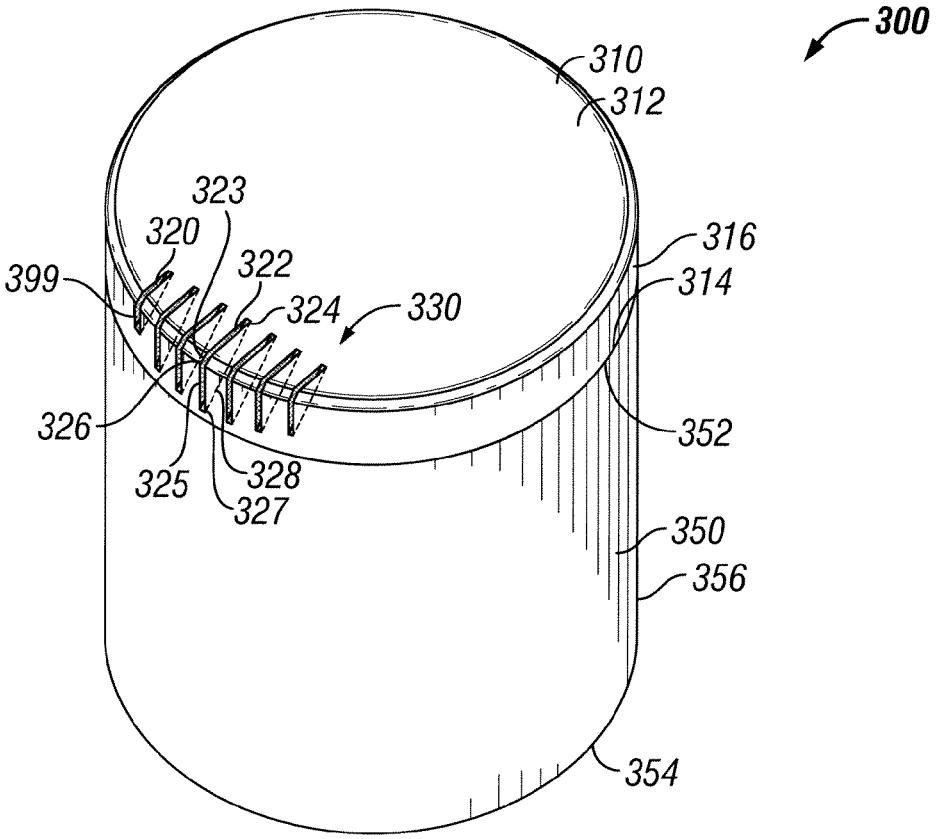
FIG. 3A shows a perspective view of a PDC cutter having one or more fins formed within a PCD cutting table in accordance with an exemplary embodiment of the present invention.
Figure 3B:
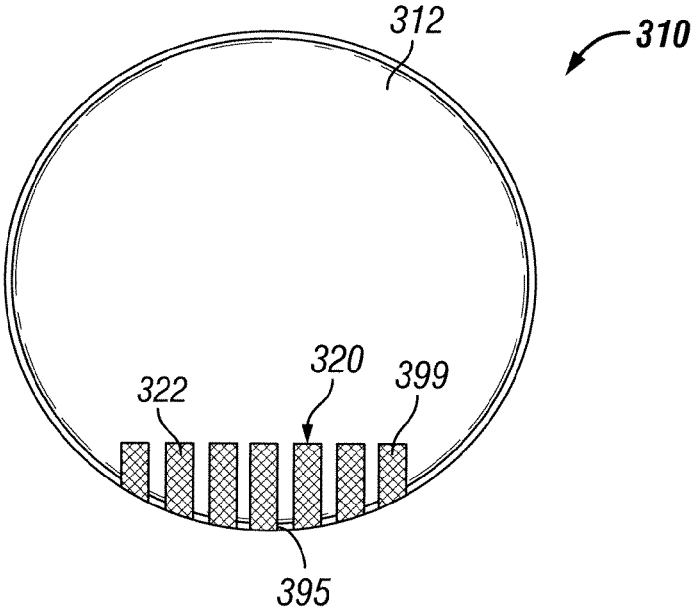
FIG. 3B shows a top view of the PCD cutting table of FIG. 3A in accordance with an exemplary embodiment of the present invention.

FIG. 3A shows a perspective view of a PDC cutter 300 having one or more fins 320 formed within a PCD cutting table 310 in accordance with an exemplary embodiment of the present invention. FIG. 3B shows a top view of the PCD cutting table 310 of FIG. 3A in accordance with an exemplary embodiment of the present invention. Although the PCD cutting table 310 is described in the exemplary embodiment, other types of cutting tables, including cubic boron nitride ("CBN") compacts, are used in alternative types of cutters. Referring to FIGS. 3A and 3B, the PDC cutter 300 includes a substrate 350 and the PCD cutting table 310 that is coupled to the substrate 350. The PCD cutting table includes one or more fins 320 formed therein.

The substrate 350 includes a top surface 352, a bottom surface 354, and a substrate outer wall 356 that extends from the circumference of the top surface 352 to the circumference of the bottom surface 354. The substrate 350 is formed into a right circular cylindrical shape according to one exemplary embodiment, but can be formed into other geometric or non-geometric shapes depending upon the application for the PDC cutter 300. According to one exemplary embodiment, the substrate 350 is formed using tungsten carbide powder and cobalt subjected to high pressures and high temperatures; however, other suitable materials known to people having ordinary skill in the art can be used without departing from the scope and spirit of the exemplary embodiment. The substrate 350 is similar to the substrate 150 (FIG. 1) except that the top surface 352 is substantially planar. However, in some exemplary embodiments, the top surface 352 is non-planar without departing from the scope and spirit of the exemplary embodiment.

The PCD cutting table 310 includes a cutting surface 312, an opposing surface 314, and a PCD cutting table outer wall 316 that extends from the circumference of the cutting surface 312 to the circumference of the opposing surface 314. According to one exemplary embodiment, the PCD cutting table 310 is formed using diamond powder and catalyst material, such as cobalt, subjected to high pressures and high temperatures; however, other suitable materials known to people having ordinary skill in the art can be used without departing from the scope and spirit of the exemplary embodiment. The PCD cutting table 310 is similar to the PCD cutting table 110 (FIG. 1) except that the opposing surface 314 is substantially planar and that fins 320 are formed therein. However, in some exemplary embodiments, the opposing surface 314 is non-planar and complementary in shape to the top surface 352 of the substrate 350 without departing from the scope and spirit of the exemplary embodiment. According to some exemplary embodiments, a bevel (not shown) is formed around at least the circumference of the PCD cutting table 310.

The PCD cutting table 310 is bonded to the substrate 350 according to methods known to people having ordinary skill in the art. In one example, the PDC cutter 300 is formed by independently forming the PCD cutting table 310 and the substrate 350, and thereafter bonding the PCD cutting table 310 to the substrate 350. In another example, the substrate 350 is initially formed and the PCD cutting table 310 is then formed on the top surface 352 of the substrate 350 by placing polycrystalline diamond powder onto the top surface 354 and subjecting the polycrystalline diamond powder and the substrate 350 to a high temperature and high pressure process.

In one exemplary embodiment, upon coupling the PCD cutting table 310 to the substrate 350, the cutting surface 312 of the PCD cutting table 310 is substantially parallel to the bottom surface 354 of the substrate 350. Additionally, the PDC cutter 300 has been illustrated as having a right circular cylindrical shape; however, the PDC cutter 300 is shaped into other geometric or non-geometric shapes in other exemplary embodiments.

According to one example, the PCD cutting table 310 is bonded to the substrate 350, such as cemented tungsten carbide, by subjecting a layer of diamond powder with or without cobalt powders to HPHT conditions. The cobalt diffuses into the diamond powder during processing and therefore acts as both a catalyst/solvent for the sintering of the diamond powder to form diamond-diamond bonds and as a binder for the tungsten carbide. Strong bonds are formed between the PCD cutting table 310 and the cemented tungsten carbide substrate 350. The diffusion of cobalt into the diamond powder results in cobalt being deposited within the voids formed within the PCD cutting table 310. Although some materials, such as tungsten carbide and cobalt, have been provided as examples, other materials known to people having ordinary skill in the art can be used to form the substrate 350, the PCD cutting table 310, and form bonds between the substrate 350 and the PCD cutting table 310.

Since the cobalt, or catalyst material, is deposited within the voids formed within the PCD cutting table 310 and cobalt has a much higher thermal expansion rate than the diamond within the PCD cutting table 310, the PCD cutting table 310 is subjected to a leaching process to improve its thermal stability according to some of the exemplary embodiments. As previously mentioned, the leaching process removes catalyst material from the voids formed between the carbon bonds. Due to the tradeoff between leaching process duration and leaching depth, the leaching depth is about 0.2 millimeters; however, the leaching depth can be varied depending upon the application the PCD cutting table 310 is to be used and/or cost constraints. The leaching depth is increased by subjecting the PCD cutting table 310 to a longer duration of the leaching process.

Figure 2A:
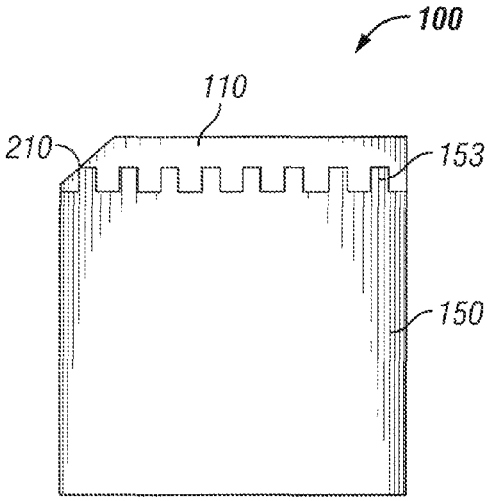
FIG. 2A (Prior Art)
FIG. 2A shows a cross-sectional view of the PDC cutter of FIG. 1 having a wear flat in the PCD cutting table in accordance with the prior art.
Figure 2B:
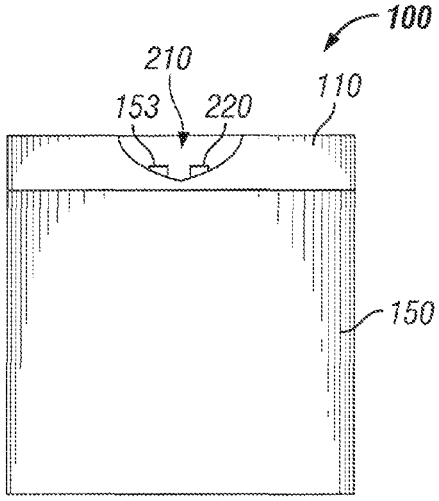
FIG. 2B (Prior Art)
FIG. 2B shows a side elevational view of the PDC cutter of FIG. 2A in accordance with the prior art.

One or more fins 320 extend from a portion of the cutting surface 312 to a portion of the PCD cutting table outer wall 316. Each fin 320 is substantially triangularly shaped and includes a fin latitudinal edge 322, a fin longitudinal edge 325, and a first fin angular edge 328. The fin latitudinal edge 322 is formed along a portion of the cutting surface 312. However, in an alternative exemplary embodiment, at least a portion of the fin latitudinal edge 322 is recessed within the cutting surface 312. The fin longitudinal edge 325 is formed along a portion of the PCD cutting table outer wall 316. However, in an alternative exemplary embodiment, at least a portion of the fin longitudinal edge 325 is recessed within the PCD cutting table outer wall 316. The first fin angular edge 328 extends from a portion of the fin latitudinal edge 322 to a portion of the fin longitudinal edge 325. The portion of the PCD cutting table 310 that is bounded by the fin latitudinal edge 322, the fin longitudinal edge 325, and the first fin angular edge 328 is occupied by a fin material 399. The fin material 399 is any ceramic, metal, such as aluminum, metal alloy, carbon vapor deposition ("CVD") diamond, cubic boron nitride ("CBN"), or carbide material including, but not limited to, molybdenum carbide, titanium carbide, vanadium carbide, iron carbide, nickel carbide, niobium carbide, and tungsten carbide. According to one example, to form the fin material 399 when the fin material 399 is a carbide material, a starting fin material that is capable of reacting with carbon which includes, but is not limited to, molybdenum, titanium, vanadium, iron, nickel, niobium, and tungsten, is used. In certain exemplary embodiments, the starting fin material does not adversely effect the sintering process of the diamond within the PCD cutting table 310, but rather promotes the sintering process in a cooperative manner or does not affect the sintering process of the diamond. Although some exemplary embodiments include triangularly shaped fins 320, other exemplary embodiments have fins 320 that are shaped in other geometric, such as square, rectangular, or tubular, or non-geometric shapes without departing from the scope and spirit of the exemplary embodiment. The fins 320 are formed substantially near the outer perimeter of the PCD cutting table 310 since that is the area performing most of the cutting. The fins 320 formed within the PCD cutting table 310 provide the claw cutting action almost immediately from when the PCD cutting table 310 commences cutting. The fins 320 wear away faster than the diamond layer of the PCD cutting table 310, thereby forming an interface 395 between the PCD cutting table 310 and the fins 320, which is similar to the interface 220 (FIG. 2) previously mentioned. The fins 320 are formed into the PCD cutting table 310 either after the PCD cutting table 310 is formed or during the sintering process that forms the PCD cutting table 310, which are both described in further detail below.

The fin latitudinal edge 322 includes a fin latitudinal adjacent end 323 and a fin latitudinal distal end 324 and extends from the fin latitudinal adjacent end 323 to the fin latitudinal distal end 324 substantially linearly. However, in other exemplary embodiments, the fin latitudinal edge 322 is substantially circular and includes the fin latitudinal adjacent end 323 and the fin latitudinal distal end 324 along opposing ends of the circumference of the fin latitudinal edge 322. The fin latitudinal adjacent end 323 is substantially positioned at a point along the circumference of the cutting surface 312. However, according to other exemplary embodiments, the fin latitudinal adjacent end 323 is positioned at a point within the circumference of the cutting surface 312. The fin latitudinal distal end 324 is positioned at a point within the circumference of the cutting surface 312 and closer towards the center of the cutting surface 312 than the positioning of the fin latitudinal adjacent end 323. In certain exemplary embodiments, both the fin latitudinal adjacent end 323 and the fin latitudinal distal end 324 are about equidistant from the center of the cutting surface 312.

The fin longitudinal edge 325 includes a fin longitudinal adjacent end 326 and a fin longitudinal distal end 327 and extends from the fin longitudinal adjacent end 326 to the fin longitudinal distal end 327 substantially linearly. However, in other exemplary embodiments, the fin longitudinal edge 325 is substantially circular and includes the fin longitudinal adjacent end 326 and the fin longitudinal distal end 327 along opposing ends of the circumference of the fin longitudinal edge 325. The fin longitudinal adjacent end 326 is positioned at a point along the PCD cutting table outer wall 316 where the PCD cutting table outer wall 316 meets with the circumference of the cutting surface 312. Thus, the positioning of the fin latitudinal adjacent end 323 and the fin longitudinal adjacent end 326 is the same. However, according to other exemplary embodiments, the fin longitudinal adjacent end 326 is positioned along the PCD cutting table outer wall 316 at a point below where the PCD cutting table outer wall 316 meets with the circumference of the cutting surface 312. According to these exemplary embodiments, the positioning of the fin latitudinal adjacent end 323 and the fin longitudinal adjacent end 326 are different. The fin longitudinal distal end 327 is positioned along the PCD cutting table outer wall 316 at a point below the fin longitudinal adjacent end 326, which is further away from where the PCD cutting table outer wall 316 meets with the circumference of the cutting surface 312 when compared to the positioning of the fin longitudinal adjacent end 326. The fin longitudinal distal end 327 is vertically aligned with the fin longitudinal adjacent end 326. In other exemplary embodiments, however, the fin longitudinal distal end 327 is not vertically aligned with the fin longitudinal adjacent end 326. For example, the fin longitudinal distal end 327 is horizontally aligned with the fin longitudinal adjacent end 326 in certain exemplary embodiments. In another example, the fin longitudinal distal end 327 is not vertically nor horizontally aligned with the fin longitudinal adjacent end 326 in other exemplary embodiments.

The first fin angular edge 328 extends from the fin latitudinal distal end 324 to the fin longitudinal distal end 327. The first fin angular edge 328 forms an angle ranging from about five degrees to about eighty-five degrees to the cutting surface 312, which is dependent upon the thickness of the PCD cutting table 310. According to some exemplary embodiments, the first fin angular edge 328 forms an angle with respect to the cutting surface 312 that is about equal to the backrake angle of the PDC cutter 300 when positioned in a downhole tool (not shown). In certain exemplary embodiments, where the positioning of the fin latitudinal adjacent end 323 and the fin longitudinal adjacent end 326 are different, a second fin angular edge (not shown) is formed extending from the fin latitudinal adjacent end 323 to the fin longitudinal adjacent end 326. According to these alternative exemplary embodiments, the portion of the PCD cutting table 310 that is bounded by the fin latitudinal edge 322, the fin longitudinal edge 325, the first fin angular edge 328, and the second fin angular edge is occupied by the fin material 399.

There are seven fins 320 formed in a group 330 on the PCD cutting table 310 according to the illustrated exemplary embodiment. The fins 320 are parallel to one another and are formed substantially adjacent to one another. The fins 320 are formed having a depth that varies from 0.1 millimeters to about several millimeters depending upon the thickness of the PCD cutting table 310. Additionally, the fins 320 are formed where the fin longitudinal edges 325 are at substantially right angles to the cutting surface 312. Further, each of fins 320 are spaced apart equidistantly from one another.

Although seven fins 320 are illustrated in one exemplary embodiment, the number of fins 320 is greater or fewer according to other exemplary embodiments. The number of fins 320 can vary from one to about fifty or even more depending upon the size of the PDC cutter 300 and/or the thickness of the fins 320. In some exemplary embodiments, each of the fins 320 are the same; however, in alternative exemplary embodiments, one or more of the fins 320 are different. For example, at least one fin 320 includes a first fin angular edge 328 that forms an angle with the cutting surface 312 that is different than the angle formed between the first fin angular edge and the cutting surface of another fin. In another example, the length of at least one of the fin latitudinal edge 322 and the fin longitudinal edge 325 of one fin 320 is different than at least one corresponding dimension of another fin. The differences in the fins' dimensions, shape, and/or orientation is allowed in certain exemplary embodiments to optimize either the volume of the PCD cutting table 310 that is subjected to the leaching process when the fins 320 are formed after the sintering process or the claw cutting action.

Additionally, although the fins 320 are formed parallel to one another according to the illustrated exemplary embodiment, the fins 320 are formed in a circumferential array, or radially, around the outer perimeter of the PCD cutting table 310 in other exemplary embodiments. According to some exemplary embodiments, the circumferential array of fins 320 is formed around a portion of the perimeter of the PCD cutting table 310. According to other exemplary embodiments, the circumferential array of fins 320 is formed around the entire perimeter of the PCD cutting table 310. The minimum spacing between the fins 320 is about thirty-three thousandths of an inch according to some exemplary embodiments; however, other exemplary embodiments have a minimum spacing between adjacent fins 320 being less than thirty-three thousandths of an inch. Although the illustrated embodiment depicts the fin longitudinal edge 325 being formed at right angles to the cutting surface 312, the fin longitudinal edge 325 can be formed at angles ranging from five degrees to about 175 degrees to the cutting surface 312. Further, although the fins 320 are formed equidistantly from one another, the spacing between adjacent fins can be varied in certain exemplary embodiments.

In some exemplary embodiments, one or more groups 330 of fins 320 are formed around the PCD cutting table 310 so that the PDC cutter 300 can be removed, rotated, and reinserted into the downhole tool, or other tool, for reuse, thereby providing new, or fresh, fins 320 for cutting. For example, once a first group 330 of fins 320 are worn away by cutting a rock formation, the PDC cutter 300 is rotated to expose an unworn group (not shown) of fins 320 for further cutting of the rock formation. The groups 330 are separated by about forty-five degrees to about 180 degrees apart depending upon the exemplary embodiment.

Figure 4:
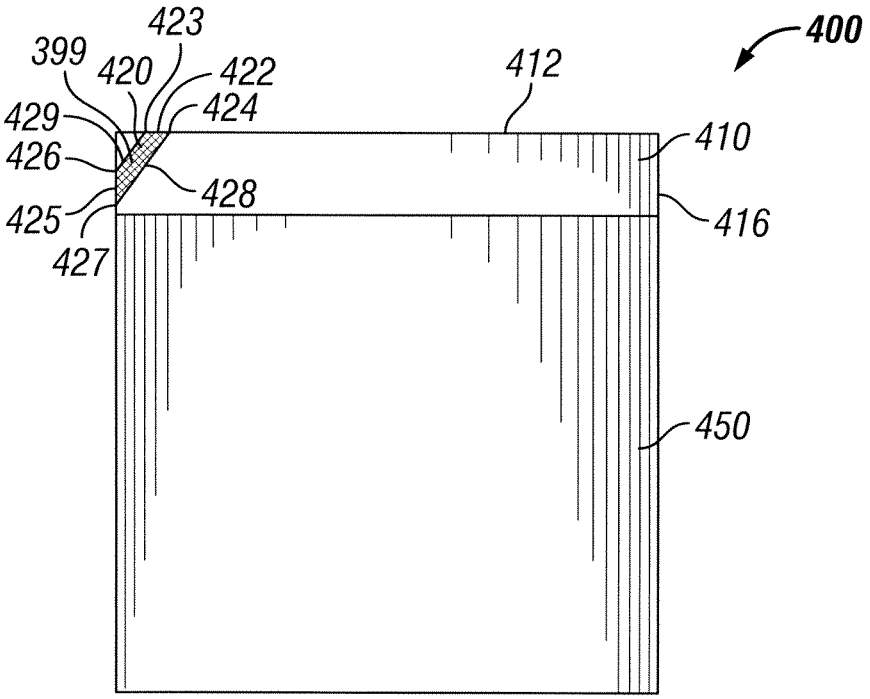
FIG. 4 shows a cross-sectional view of a PDC cutter having one or more fins formed within a PCD cutting table in accordance with another exemplary embodiment of the present invention.

FIG. 4 shows a cross-sectional view of a PDC cutter 400 having one or more fins 420 formed within a PCD cutting table 410 in accordance with another exemplary embodiment of the present invention. Referring to FIG. 4, the PDC cutter 400 includes the PCD cutting table 410 that is coupled to a substrate 450 according to methods known to people having ordinary skill in the art. The PDC cutter 400 is similar to PDC cutter 300 (FIG. 3A) except PCD cutting table 410 includes at least one fin 420 that is different than the fin 320 (FIG. 3A). Similar to PCD cutting table 310 (FIG. 3A), PCD cutting table 410 includes a cutting surface 412 and a PCD cutting table outer wall 416.

Each fin 420 is substantially tubularly shaped and includes a fin latitudinal edge 422, a fin longitudinal edge 425, a first fin angular edge 428, and a second tin angular edge 429. The fin latitudinal edge 422 is formed along a portion of the cutting surface 412. However, in an alternative exemplary embodiment, at least a portion of the fin latitudinal edge 422 is recessed within the cutting surface 412. The fin longitudinal edge 425 is formed along a portion of the PCD cutting table outer wall 416. However, in an alternative exemplary embodiment, at least a portion of the tin longitudinal edge 425 is recessed within the PCD cutting table outer wall 416. Each of the first fin angular edge 428 and the second fin angular edge 429 extend from a portion of the fin latitudinal edge 422 to a portion of the tin longitudinal edge 425. The portion of the PCD cutting table 410 that is bounded by the fin latitudinal edge 422, the fin longitudinal edge 425, the first fin angular edge 428, and the second fin angular edge 429 is occupied by the fin material 399, thereby forming the fin 420. Although some exemplary embodiments include tubular shaped fins 420, other exemplary embodiments have fins 420 that are shaped in other geometric, such as square or trapezoidal, or non-geometric shapes without departing from the scope and spirit of the exemplary embodiment. The fins 420 are formed substantially near the outer perimeter of the PCD cutting table 410 since that is the area performing most of the cutting. The fins 420 formed within the PCD cutting table 410 provide the claw cutting action almost immediately from when the PCD cutting table 410 commences cutting. The fins 420 wear away faster than the diamond layer of the PCD cutting table 410, thereby forming an interface (not shown) between the PCD cutting table 410 and the fins 420, which is similar to the interface 220 (FIG. 2) previously mentioned. The fins 420 are firmed into the PCD cutting table 410 either after the PCD cutting table 410 is formed or during the sintering process that forms the PCD cutting table 410, which are both described in further detail below.

The fin latitudinal edge 422 includes a fin latitudinal adjacent end 423 and a fin latitudinal distal end 424 and extends from the fin latitudinal adjacent end 423 to the fin latitudinal distal end 424 substantially linearly. However, in other exemplary embodiments, the fin latitudinal edge 422 is substantially circular and includes the fin latitudinal adjacent end 423 and the fin latitudinal distal end 424 along opposing ends of the circumference of the fin latitudinal edge 422. The fin latitudinal adjacent end 423 is positioned at a point within the circumference of the cutting surface 412. The fin latitudinal distal end 424 is positioned at a point within the circumference of the cutting surface 412 and closer towards the center of the cutting surface 412 than the positioning of the fin latitudinal adjacent end 423.

The fin longitudinal edge 425 includes a fin longitudinal adjacent end 426 and a fin longitudinal distal end 427 and extends from the fin longitudinal adjacent end 426 to the fin longitudinal distal end 427 substantially linearly. However, in other exemplary embodiments, the fin longitudinal edge 425 is substantially circular and includes the fin longitudinal adjacent end 426 and the fin longitudinal distal end 427 along opposing ends of the circumference of the fin longitudinal edge 425. The fin longitudinal adjacent end 426 is positioned along the PCD cutting table outer wall 416 at a point below where the PCD cutting table outer wall 416 meets with the circumference of the cutting surface 412. The fin longitudinal distal end 427 is positioned along the PCD cutting table outer wall 416 at a point below the fin longitudinal adjacent end 426, which is further away from where the PCD cutting table outer wall 416 meets with the circumference of the cutting surface 412 when compared to the positioning of the fin longitudinal adjacent end 426. The fin longitudinal distal end 427 is vertically aligned with the fin longitudinal adjacent end 426. In other exemplary embodiments, however, the fin longitudinal distal end 427 is not vertically aligned with the fin longitudinal adjacent end 426.

The first fin angular edge 428 extends from the fin latitudinal distal end 424 to the fin longitudinal distal end 427. The first fin angular edge 428 forms an angle ranging from about five degrees to about eighty-five degrees to the cutting surface 412, which is dependent upon the thickness of the PCD cutting table 410. According to some exemplary embodiments, the first fin angular edge 428 forms an angle with respect to the cutting surface 412 that is about equal to the backrake angle of the PDC cutter 400 when positioned in a downhole tool (not shown).

The second fin angular edge 429 extends from the fin latitudinal adjacent end 423 to the fin longitudinal adjacent end 426. The second fin angular edge 429 forms an angle ranging from about five degrees to about eighty-five degrees to the cutting surface 412, which is dependent upon the thickness of the PCD cutting table 410. According to some exemplary embodiments, the second fin angular edge 429 forms an angle with respect to the cutting surface 412 that is about equal to the backrake angle of the PDC cutter 400 when positioned in a downhole tool. Although the first fin angular edge 428 is substantially parallel to the second fin angular edge 429, the first fin angular edge 428 is not substantially parallel to the second fin angular edge 429 in other exemplary embodiments.

Figure 5:
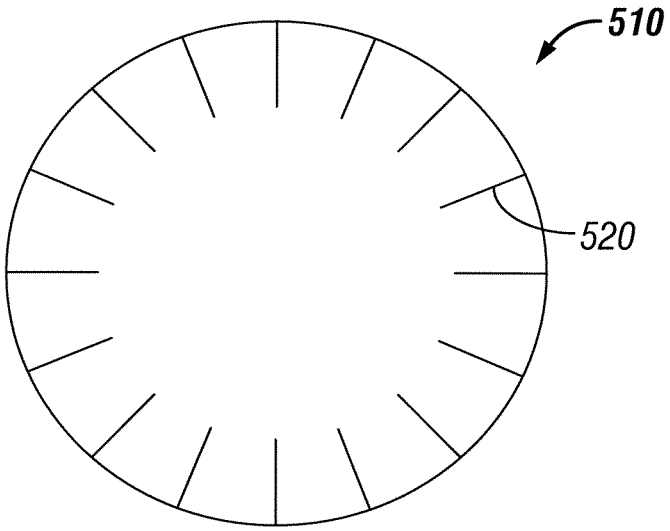
FIG. 5 shows a top view of a PCD cutting table having one or more fins in accordance with another exemplary embodiment of the present invention.

FIG. 5 shows a top view of a PCD cutting table 510 having one or more fins 520 in accordance with another exemplary embodiment of the present invention. The PCD cutting table 510 includes one or more fins 520 and is similar to PCD cutting table 310 (FIG. 3A), except the fins 520 are formed in a circumferential array, or radially, around the entire outer perimeter of the PCD cutting table 510. Fins 520 are formed similarly to fins 320 (FIG. 3A), but can also be formed similar to fins 420 (FIG. 4) in other exemplary embodiments. According to some exemplary embodiments, however, the circumferential array of fins 520 is formed around a portion of the perimeter of the PCD cutting table 510. The minimum spacing between the fins 520 is about thirty-three thousandths of an inch according to some exemplary embodiments; however, other exemplary embodiments have a minimum spacing between adjacent fins 520 being less than thirty-three thousandths of an inch. Further, although the fins 520 are formed equidistantly from one another, the spacing between adjacent fins 520 can be varied in certain exemplary embodiments.

Figure 6:
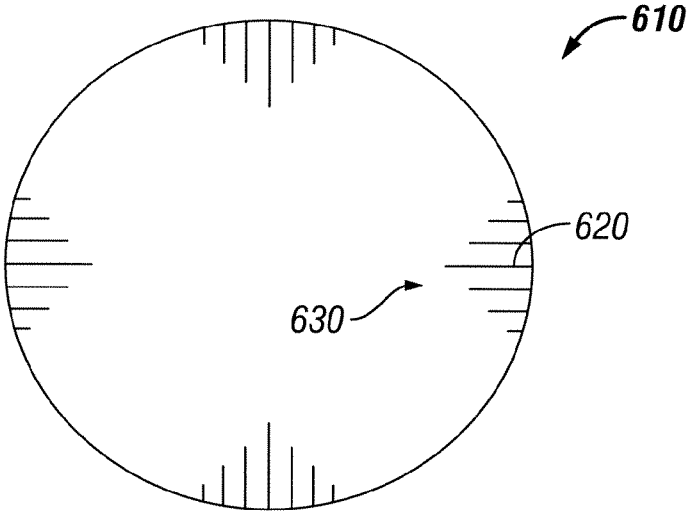
FIG. 6 shows a top view of a PCD cutting table having one or more fins in accordance with another exemplary embodiment of the present invention.

FIG. 6 shows a top view of a PCD cutting table 600 having one or more fins 620 in accordance with another exemplary embodiment of the present invention. The PCD cutting table 610 is similar to PCD cutting table 310 (FIG. 3A), except that PCD cutting table 610 includes one or more groups 630 of fins 620. Fins 620 are formed similarly to fins 320 (FIG. 3A), but can be formed similarly to fins 420 (FIG. 4) in other exemplary embodiments. There are four groups 630 that are oriented about ninety degrees apart; however, the separation between adjacent groups can be at various angles ranging from about forty-five degrees to 180 degrees depending upon application desires and the number of fins 620 within each group 630. According to one exemplary embodiment, four groups 630 are formed within the PCD cutting table 610. Each group 630 includes seven parallel fins 620. The number of fins 620 per group 630 is variable in different exemplary embodiments. Additionally, the number of groups 630 is variable in different exemplary embodiments. Further, the fins 620 can be positioned radially, instead of parallel, according to some exemplary embodiments. Groups 630 are formed around the PCD cutting table 610 so that the cutter (not shown) can be removed, rotated, and reinserted into the downhole tool (not shown), or other tool, for reuse, thereby providing a new, or fresh, fins 620 of the PCD cutting table 610 for cutting. For example, once a first group 630 of fins 620 are worn away by cutting a rock formation, the cutter can be rotated to expose a different group 630 that is unworn for further cutting of the rock formation.

Referring to FIGS. 3-6 and as previously mentioned, the fins 320, 420, 520, or 620 are formed either after the PCD cutting table 310, 410, 510, or 610 is formed or during the high pressure high temperature sintering process which forms the PCD cutting table 310, 410, 510, or 610. One method for forming the fins 320, 420, 520, or 620 after the PCD cutting table 310, 410, 510, or 610 is formed is described in conjunction with FIG. 7 below. One method for forming the fins 320, 420, 520, or 620 during the high pressure high temperature sintering process of the PCD cutting table 310, 410, 510, or 610 is described in conjunction with FIGS. 8A, 8B, and 8C below.

Figure 7:
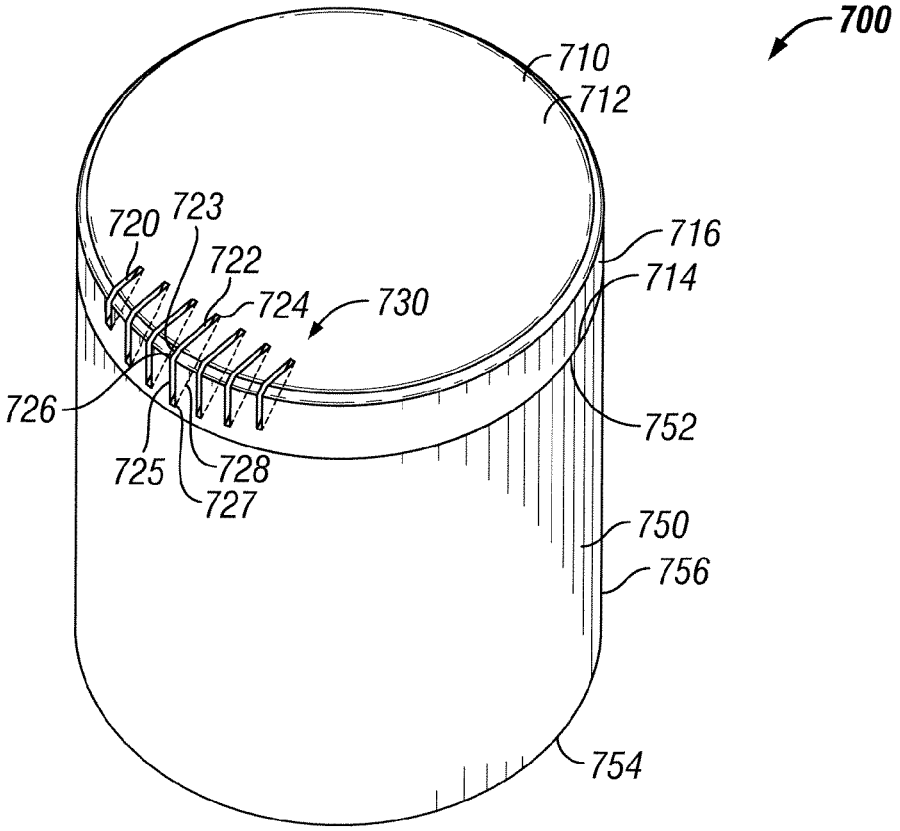
FIG. 7 shows a perspective view of a slotted PDC cutter having one or more slots that are used to form the PDC cutter of FIG. 3A in accordance with an exemplary embodiment of the present invention.

FIG. 7 shows a perspective view of a slotted PDC cutter 700 having one or more slots 720 that are used to form the PDC cutter 300 of FIG. 3A in accordance with an exemplary embodiment of the present invention. Once the slots 720 of slotted PDC cutter 700 has been backfilled with fin material 399 (FIG. 3A), PDC cutter 300 (FIG. 3A) is formed. According to some exemplary embodiments, the entire slot 720 is backfilled using fin material 399 to form fins 320 (FIG. 3A). In other exemplary embodiments, a portion of the slot 720 is backfilled using fin material 399 to form fins 320 (FIG. 3A). FIG. 7 provides one example for forming fins 320 (FIG. 3A) into the PCD cutting table 310 (FIG. 3A) after the PCD cutting table 310 (FIG. 3A) is formed. Referring to FIG. 7, the slotted PDC cutter 700 includes a substrate 750 and a PCD cutting table 710 that is coupled to the substrate 750. The PCD cutting table 710 includes one or more slots 720 formed therein.

The substrate 750 includes a top surface 752, a bottom surface 754, and a substrate outer wall 756 that extends from the circumference of the top surface 752 to the circumference of the bottom surface 754. The substrate 750 is similar to substrate 350 (FIG. 3A). The PCD cutting table 710 includes a cutting surface 712, an opposing surface 714, and a PCD cutting table outer wall 716 that extends from the circumference of the cutting surface 712 to the circumference of the opposing surface 714. The PCD cutting table 710 is similar to the PCD cutting table 310 (FIG. 3A) except that PCD cutting table 710 includes one or more slots 720 rather than one or more fins 320 (FIG. 3A).

One or more slots 720 extend from a portion of the cutting surface 712 to a portion of the PCD cutting table outer wall 716. Each slot 720 is substantially triangularly shaped and includes a slot latitudinal edge 722, a slot longitudinal edge 725, and a first slot angular edge 728. The slot latitudinal edge 722 is formed along a portion of the cutting surface 712. The slot longitudinal edge 725 is formed along a portion of the PCD cutting table outer wall 716. The first slot angular edge 728 extends from a portion of the slot latitudinal edge 722 to a portion of the slot longitudinal edge 725. The portion of the PCD cutting table 710 that is bounded by the slot latitudinal edge 722, the slot longitudinal edge 725, and the first slot angular edge 728 is removed, thereby forming the slot 720. Although some exemplary embodiments include triangularly shaped slots 720, other exemplary embodiments have slots 720 that are shaped in other geometric, such as square, rectangular, or tubular, or non-geometric shapes without departing from the scope and spirit of the exemplary embodiment. The slots 720 are formed substantially near the outer perimeter of the PCD cutting table 710 since that is the area performing most of the cutting. The slots 720 formed within the PCD cutting table 710 provide greater surface area of the PCD cutting table 710 that is exposed to the leaching process, if desired.

The slot latitudinal edge 722 includes a slot latitudinal adjacent end 723 and a slot latitudinal distal end 724 and extends from the slot latitudinal adjacent end 723 to the slot latitudinal distal end 724 substantially linearly. However, in other exemplary embodiments, the slot latitudinal edge 722 is substantially circular and includes the slot latitudinal adjacent end 723 and the slot latitudinal distal end 724 along opposing ends of the circumference of the slot latitudinal edge 722. The slot latitudinal adjacent end 723 is substantially positioned at a point along the circumference of the cutting surface 712. However, according to other exemplary embodiments, the slot latitudinal adjacent end 723 is positioned at a point within the circumference of the cutting surface 712. The slot latitudinal distal end 724 is positioned at a point within the circumference of the cutting surface 712 and closer towards the center of the cutting surface 712 than the positioning of the slot latitudinal adjacent end 723. In certain exemplary embodiments, both the slot latitudinal adjacent end 723 and the slot latitudinal distal end 724 are about equidistant from the center of the cutting surface 712.

The slot longitudinal edge 725 includes a slot longitudinal adjacent end 726 and a slot longitudinal distal end 727 and extends from the slot longitudinal adjacent end 726 to the slot longitudinal distal end 727 substantially linearly. However, in other exemplary embodiments, the slot longitudinal edge 725 is substantially circular and includes the slot longitudinal adjacent end 726 and the slot longitudinal distal end 727 along opposing ends of the circumference of the slot longitudinal edge 725. The slot longitudinal adjacent end 726 is positioned at a point along the PCD cutting table outer wall 716 where the PCD cutting table outer wall 716 meets with the circumference of the cutting surface 712. Thus, the positioning of the slot latitudinal adjacent end 723 and the slot longitudinal adjacent end 726 is the same. However, according to other exemplary embodiments, the slot longitudinal adjacent end 726 is positioned along the PCD cutting table outer wall 716 at a point below where the PCD cutting table outer wall 716 meets with the circumference of the cutting surface 712. According to these exemplary embodiments, the positioning of the slot latitudinal adjacent end 723 and the slot longitudinal adjacent end 726 are different. The slot longitudinal distal end 727 is positioned along the PCD cutting table outer wall 716 at a point below the slot longitudinal adjacent end 726, which is further away from where the PCD cutting table outer wall 716 meets with the circumference of the cutting surface 712 when compared to the positioning of the slot longitudinal adjacent end 726. The slot longitudinal distal end 727 is vertically aligned with the slot longitudinal adjacent end 726. In other exemplary embodiments, however, the slot longitudinal distal end 727 is not vertically aligned with the slot longitudinal adjacent end 726. For example, the slot longitudinal distal end 727 is horizontally aligned with the slot longitudinal adjacent end 726 in certain exemplary embodiments. In another example, the slot longitudinal distal end 727 is not vertically nor horizontally aligned with the slot longitudinal adjacent end 726 in other exemplary embodiments.

The first slot angular edge 728 extends from the slot latitudinal distal end 724 to the slot longitudinal distal end 727. The first slot angular edge 728 forms an angle ranging from about five degrees to about eighty-five degrees to the cutting surface 712, which is dependent upon the thickness of the PCD cutting table 710. According to some exemplary embodiments, the first slot angular edge 728 forms an angle with respect to the cutting surface 712 that is about equal to the backrake angle of the slotted PDC cutter 700 when positioned in a downhole tool (not shown). In certain exemplary embodiments, where the positioning of the slot latitudinal adjacent end 723 and the slot longitudinal adjacent end 726 are different, a second slot angular edge (not shown) is formed extending from the slot latitudinal adjacent end 723 to the slot longitudinal adjacent end 726. According to these alternative exemplary embodiments, the portion of the PCD cutting table 710 that is bounded by the slot latitudinal edge 722, the slot longitudinal edge 725, the first slot angular edge 728, and the second slot angular edge is removed to form the slot 720.

There are seven slots 720 formed in a group 730 on the PCD cutting table 710 according to the illustrated exemplary embodiment. The slots 720 are parallel to one another and are formed substantially adjacent to one another. The slots 720 are formed having a depth that varies from 0.1 millimeters to about several millimeters depending upon the thickness of the PCD cutting table 710. Additionally, the slots 720 are formed where the slot longitudinal edges 725 are at substantially right angles to the cutting surface 712. Further, each of slots 720 are spaced apart equidistantly from one another.

Although seven slots 720 are illustrated in one exemplary embodiment, the number of slots 720 is greater or fewer according to other exemplary embodiments. The number of slots 720 can vary from one to about fifty or even more depending upon the size of the slotted PDC cutter 700 and/or the thickness of the slots 720. In some exemplary embodiments, each of the slots 720 are the same; however, in alternative exemplary embodiments, one or more of the slots 720 are different. For example, at least one slot 720 includes a first slot angular edge 728 that forms an angle with the cutting surface 712 that is different than the angle formed between the first slot angular edge and the cutting surface of another slot. In another example, the length of at least one of the slot latitudinal edge 722 and the slot longitudinal edge 725 of one slot 720 is different than at least one corresponding dimension of another slot. The differences in the slots' dimensions, shape, and/or orientation is allowed in certain exemplary embodiments to optimize either the volume of the PCD cutting table 710 that is subjected to the leaching process, if performed, or the claw cutting action once the fin material 399 (FIG. 3A) is formed within the slots 720.

Additionally, although the slots 720 are formed parallel to one another according to the illustrated exemplary embodiment, the slots 720 are formed in a circumferential array, or radially, around the outer perimeter of the PCD cutting table 710 in other exemplary embodiments. According to some exemplary embodiments, the circumferential array of slots 720 is formed around a portion of the perimeter of the PCD cutting table 710. According to other exemplary embodiments, the circumferential array of slot 720 is formed around the entire perimeter of the PCD cutting table 710. The minimum spacing between the slots 720 is about thirty-three thousandths of an inch according to some exemplary embodiments; however, other exemplary embodiments have a minimum spacing between adjacent slots 720 being less than thirty-three thousandths of an inch. Although the illustrated embodiment depicts the slot longitudinal edge 725 being formed at right angles to the cutting surface 712, the slot longitudinal edge 725 can be formed at angles ranging from five degrees to about 175 degrees to the cutting surface 712. Further, although the slots 720 are formed equidistantly from one another, the spacing between adjacent slots 720 can be varied in certain exemplary embodiments.

In some exemplary embodiments, one or more groups 730 of slots 720 are formed around the PCD cutting table 710 so that the PDC cutter 300 (FIG. 3A), which is formed once the slots 720 have been backfilled with the fin material 399 (FIG. 3A), can be removed, rotated, and reinserted into the downhole tool, or other tool, for reuse, thereby providing new, or fresh, fins 320 (FIG. 3A) for cutting. The groups 730 are separated by about forty-five degrees to about 180 degrees apart depending upon the exemplary embodiment.

The slots 720 are formed mechanically using a grinding wheel and/or a saw blade. However, the slots 720 are formed using an electric discharge machine, such as a wire electrical discharge machining ("wire EDM") in another exemplary embodiment. In yet another exemplary embodiment, the slots 720 are formed using laser cutting machines. Although a few examples have been provided for forming the slots 720, other methods known to people having ordinary skill in the art having the benefit of the present disclosure can be used without departing from the scope and spirit of the exemplary embodiment.

Once the slots 720 are formed and according to some exemplary embodiments, the PCD cutting table 710 is optionally leached using leaching methods known to people having ordinary skill in the art. This leaching provides the benefits and advantages discussed in U.S. patent application Ser. No. 12/862,401, entitled "Functionally Leached PCD Cutter, which was filed on Aug. 24, 2010, and which has been previously incorporated by reference herein. Thus, the PCD cutting table 710 provides the benefits mentioned within that disclosure.

Referring to FIGS. 3A, 3B, and 7, once the slots 720 are formed into the PCD cutting table 710 and after the optional leaching process, if performed, one or more slots 720 are backfilled, using the fin material 399 or some other material that eventually forms the fin material 399. Once the fin material 399 is formed, the slotted PDC cutter 700 is transformed into the PDC cutter 300, which includes the fins 320. There are several techniques that can be used for forming the fin material 399 within the slots 720, which thereby forms the fins 320. Some of these techniques include, but are not limited to, painting, coating, soaking, dripping, plasma vapor deposition, chemical vapor deposition, and plasma enhanced chemical vapor deposition and can be used in conjunction with masking certain portions of the top surface of the PCD cutting table 710. These backfilling techniques are described in U.S. patent application Ser. No. 12/716,208, entitled "Backfilled Polycrystalline Diamond Cutter With High Thermal Conductivity" and filed on Mar. 2, 2010, which is incorporated by reference herein. As previously mentioned, according to the exemplary embodiments, either the entire slot 720 is backfilled or a portion of the slot 720 is backfilled.

According to some exemplary embodiments, the fin material 399 is formed within the PCD cutting table 710 by inserting the starting fin material, which can be a metal in either wire form or in powder form, into the slots 720. Upon inserting the starting fin material within one or more slots 720, the PCD cutting table 710 is subjected to the high pressure high temperature conditions so that the starting fin material reacts with the carbon within the PCD cutting table 710. The starting fin material converts into its carbide form, or fin material 399, and hence forms the fins 320.

According to some exemplary embodiments using certain techniques, such as chemical vapor deposition, substantially all of the top surface of the PCD cutting table 710 has a mask placed thereon except for the slots 720, so that only the slots 720 are backfilled. According to certain other exemplary embodiments using certain techniques, such as chemical vapor deposition, the interior portion of the top surface of the PCD cutting table 710 has a mask placed thereon except for on the outer circumference of the PCD cutting table 710, which includes the slots 720. Thus, the slots 720 and the remaining outer circumference of the PCD cutting table 710 are backfilled using starting fin material.

Figure 8A:
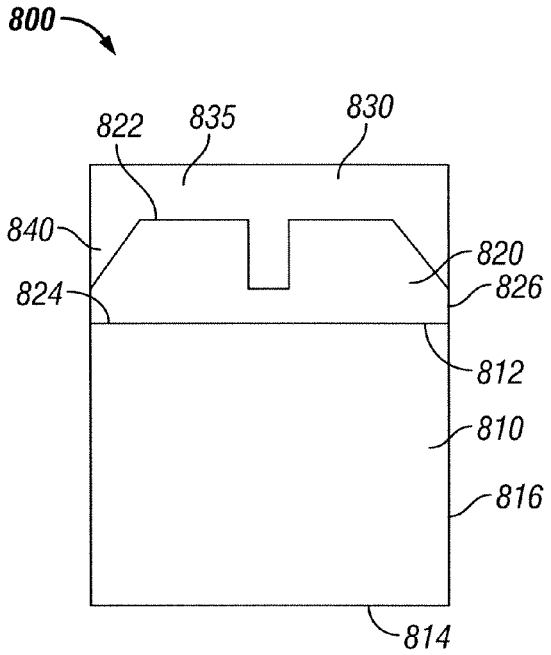
FIG. 8A shows a side view of a fin fabricating apparatus for fabricating one or more fins on a PCD cutting table in accordance with an exemplary embodiment of the present invention.
Figure 8B:
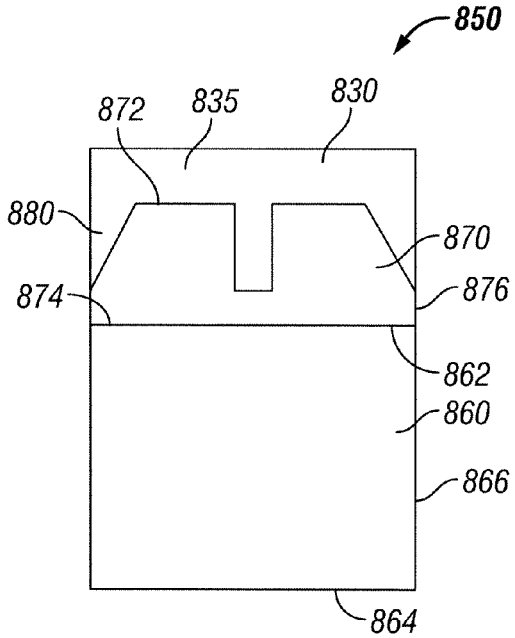
FIG. 8B shows a side view of a sintered fin fabricating apparatus formed from the sintering of the fin fabricating apparatus of FIG. 8A in accordance with an exemplary embodiment of the present invention.
Figure 8C:
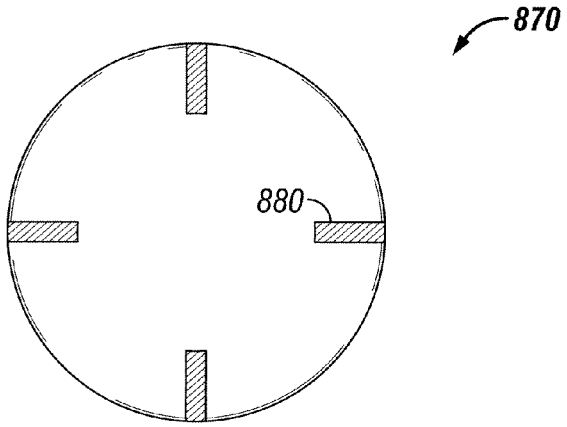
FIG. 8C shows a top view of the PCD cutting table of FIG. 8B with the top portion of the cap removed in accordance with an exemplary embodiment of the present invention.

FIG. 8A shows a side view of a fin fabricating apparatus 800 for fabricating one or more fins 880 on a PCD cutting table 870 in accordance with an exemplary embodiment of the present invention. FIG. 8B shows a side view of a sintered fin fabricating apparatus 850 formed from the sintering of the fin fabricating apparatus 800 of FIG. 8A in accordance with an exemplary embodiment of the present invention. FIG. 8C shows a top view of the PCD cutting table 870 of FIG. 8B with the top portion 835 of the cap 830 removed in accordance with an exemplary embodiment of the present invention. FIGS. 8A-8C provide one example for forming the fins 880 during the sintering process of the PCD cutting table 870. Referring to FIGS. 8A, 8B, and 8C, the fin fabricating apparatus 800 includes a substrate layer 810, a PCD cutting table layer 820, and a cap 830. The substrate layer 810 is positioned at the bottom of the fin fabricating apparatus 800 and forms a substrate 860 upon performing the sintering process. The PCD cutting table layer 820 is positioned atop the substrate layer 810 and forms a PCD cutting table 870 upon performing the sintering process. The cap 830 includes a top portion 835 and one or more extenders 840. The cap 830 is positioned atop the PCD cutting table layer 820 and the extenders 840 are positioned so that the extenders 840 extend from the top portion 835 into portions of the outer circumference of the PCD cutting table layer 820.

The substrate layer 810 is formed from tungsten carbide powder and cobalt powder. Once subjected to high pressures and high temperatures, the substrate layer 810 forms the substrate 860. However, in alternative exemplary embodiments, the substrate layer 810 is formed from other suitable materials known to people having ordinary skill in the art. The substrate layer 810 includes a top layer surface 812, a bottom layer surface 814, and a substrate layer outer wall 816 that extends from the circumference of the top layer surface 812 to the circumference of the bottom layer surface 814. The substrate layer 810 is formed into a right circular cylindrical shape according to one exemplary embodiment, but can be formed into other geometric or non-geometric shapes.

The PCD cutting table layer 820 is formed from diamond powder; however, other suitable materials known to people having ordinary skill in the art can be used without departing from the scope and spirit of the exemplary embodiment. Once subjected to high pressures and high temperatures, the PCD cutting table layer 820 forms the PCD cutting table 870. The PCD cutting table layer 820 includes a cutting layer surface 822, an opposing layer surface 824, and a PCD cutting table layer outer wall 826 that extends from the circumference of the cutting layer surface 822 to the circumference of the opposing layer surface 824.

The cap 830 is formed from molybdenum; however, the cap 830 is formed from any other suitable material, such as tungsten, ceramic, metals, metal alloys, CBN, or any other material known to people having ordinary skill in the art, in other exemplary embodiments. The cap 830 is placed atop the PCD cutting table layer 820 such that the extenders 840 extend from the top portion 835 of the cap 830 and proceed into a portion of the cutting layer surface 822 and to a portion of the PCD cutting table layer outer wall 826. In some exemplary embodiments, the extenders 840 are positioned substantially towards the outer perimeter of the PCD cutting table layer 820.

Once the fin fabricating apparatus 800 is formed, the fin fabricating apparatus 800 is subjected to high pressure and high temperature conditions to form the sintered slot fabricating apparatus 850. Within the sintered slot fabricating apparatus 850, the substrate 860 is formed, the PCD cutting layer 870 is formed, the substrate 860 is bonded to the PCD cutting layer 870, and the cap 830 is bonded to the PCD cutting layer 870. Additionally, the extenders 840 are transformed into fins 880, which is now a carbide form of the extenders 840. The fins 880 are now a part of the PCD cutting table 870. The substrate 860 includes a top surface 862, a bottom surface 864, and a substrate outer wall 866 that extends from the circumference of the top surface 862 to the circumference of the bottom surface 864. The PCD cutting table 870 includes a cutting surface 872, an opposing surface 874, and a PCD cutting table outer wall 876 that extends from the circumference of the cutting surface 872 to the circumference of the opposing surface 874. The opposing surface 874 is bonded to the top surface 862 and the top portion 835 of the cap 830 is bonded to the cutting surface 872.

According to one exemplary embodiment, upon forming the sintered slot fabricating apparatus 850, the top portion 835 of the cap 1430 is removed while the fins 880 are allowed to remain embedded within the PCD cutting table 870. According to some exemplary embodiments, a portion of the fins 880 are also removed so that one or more fins 880 are recessed into the cutting surface 872. The removal of the top portion 835 exposes the cutting surface 872 of the PCD cutting table 870 and a greater portion of the fins 880, which is illustrated in FIG. 8C. The fins 880 extend from a portion of the cutting surface 872 to a portion of the PCD cutting table outer wall 876. Although each fin 880 is formed at ninety degrees from one another, the fins 880 are formed according to any of the previously mentioned exemplary embodiments in other exemplary embodiments. According to certain exemplary embodiments of the fins 880, the extenders 840 of the cap 830 are modified so that fins 880 in the shape of tubulars are formed, which extend from entirely an inner portion of the cutting surface 872 to a portion of the PCD cutting table outer wall 876.

The top portion 835 is removed mechanically, for example grinding, chemically, via laser, or any other methods known to people having ordinary skill in the art according to some exemplary embodiments. According to another exemplary embodiment, the sintered slot fabricating apparatus 850 is inserted within the downhole tool and is used to cut the rock formation. During the cutting process, the top portion 835 is easily removed, thereby allowing the cutting surface 872 of the PCD cutting table 870 and the fins 880, which are formed from the extenders 840, to perform the cutting.

In some exemplary embodiments, the cap 835 and the fins 880 are removed to form slots 720 (FIG. 7). The cap 830 is removed using acid which dissolves the entire cap 830, including the fins 880. In certain exemplary embodiments, the acid is allowed to leach catalyst material from portions of the PCD cutting table 870, including surrounding areas near the slots 720 (FIG. 7) that are formed by the removal of the fins 880. The leaching process can be performed on the slots 720 (FIG. 7) as previously mentioned, and thereafter, the slots 720 (FIG. 7) can be backfilled to refabricate the fins 880.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A cutting table, comprising:
a cutting surface;
an opposing surface;
a cutting table outer wall extending from the circumference of the opposing surface to the circumference of the cutting surface; and
one or more fins extending from of the cutting surface to of the cutting table outer wall,
wherein the cutting surface, the opposing surface, and the cutting table outer wall comprise leached polycrystalline diamond and wherein said fins have lower wear resistance than said cutting surface.

2. The cutting table of claim 1, wherein the fins comprise a first fin and an adjacent second fin, the first fin being parallel to the adjacent second fin.

3. The cutting table of claim 1, wherein at least a portion of the fins are positioned circumferentially around at least a portion of the cutting surface.

4. The cutting table of claim 1, wherein the fins comprise a metal carbide.

5. The cutting table of claim 1, wherein the fins form at least a first group of fins and a second group of fins, the second group of fins being positioned about forty-five degrees to about 180 degrees apart from the first group of fins.

6. The cutting table of claim 1, wherein the fins are formed around the outer perimeter of the cutting surface.

7. The cutting table of claim 1, wherein the fins are formed after the cutting table is formed.

8. The cutting table of claim 1, wherein the fins are formed during the formation of the cutting table.

9. The cutting table of claim 1, wherein at least the cutting surface and at least portions around the fins are subjected to a leaching process.

10. The cutting table of claim 1, wherein at least one fin comprises:
a fin latitudinal edge positioned along the cutting surface, the fin latitudinal edge comprising a fin latitudinal adjacent end and a fin latitudinal distal end;
a fin longitudinal edge positioned along the cutting table outer wall, the fin longitudinal edge comprising a fin longitudinal adjacent end and a fin longitudinal distal end; and
a first fin angular edge extending from the fin latitudinal distal end to the fin longitudinal distal end.

11. The cutting table of claim 10, wherein the fin latitudinal adjacent end is the same as the fin longitudinal adjacent end.

12. The cutting table of claim 10, wherein the fin further comprises a second fin angular edge extending from the fin latitudinal adjacent end to the fin longitudinal adjacent end, wherein the fin latitudinal adjacent end is different than the fin longitudinal adjacent end.

13. The cutting table of claim 12, wherein at least one fin is tubular shaped.

14. The cutting table of claim 10, wherein the fin longitudinal distal end is vertically aligned with the fin longitudinal adjacent end.

15. A cutter, comprising:
a substrate comprising a top surface;
a cutting table, comprising:
a cutting surface;
an opposing surface coupled to the top surface;
a cutting table outer wall extending from the circumference of the opposing surface to the circumference of the cutting surface; and
one or more fins extending from a portion of the cutting surface to a portion of the cutting table outer wall,
wherein the cutting surface, the opposing surface, and the cutting table outer wall comprise leached polycrystalline diamond and have a higher wear resistance than at least one of said one or more fins.

16. The cutter of claim 15, wherein the fins comprise a first fin and an adjacent second fin, the first fin being parallel to the adjacent second fin.

17. The cutter of claim 15, wherein at least a portion of the fins are positioned circumferentially around at least a portion of the cutting surface.

18. The cutter of claim 15, wherein the fins comprise a metal carbide.

19. The cutter of claim 15, wherein the fins form at least a first group of fins and a second group of fins, the second group of fins being positioned about forty-five degrees to about 180 degrees apart from the first group of fins.

20. The cutter of claim 15, wherein the fins are formed around the outer perimeter of the cutting surface.

21. The cutter of claim 15, wherein the fins are formed after the cutting table is formed.

22. The cutter of claim 15, wherein the fins are formed during the formation of the cutting table.

23. The cutter of claim 15, wherein at least the cutting surface and at least portions around the fins are subjected to a leaching process.

24. The cutter of claim 15, wherein at least one fin comprises:
a fin latitudinal edge positioned along the cutting surface, the fin latitudinal edge comprising a fin latitudinal adjacent end and a fin latitudinal distal end;

a fin longitudinal edge positioned along the cutting table outer wall, the fin longitudinal edge comprising a fin longitudinal adjacent end and a fin longitudinal distal end; and a first fin angular edge extending from the fin latitudinal distal end to the fin longitudinal distal end.

25. The cutter of claim 24, wherein the fin latitudinal adjacent end is the same as the fin longitudinal adjacent end.

26. The cutter of claim 24, wherein the fin further comprises a second fin angular edge extending from the fin latitudinal adjacent end to the fin longitudinal adjacent end, wherein the fin latitudinal adjacent end is different than the fin longitudinal adjacent end.

27. The cutter of claim 26, wherein at least one fin is tubular shaped.

28. The cutter of claim 24, wherein the fin longitudinal distal end is vertically aligned with the fin longitudinal adjacent end.

29. A method for fabricating a cutter, comprising:

forming a cutting table, the cutting table comprising:

a cutting surface;

an opposing surface; and a cutting table outer wall extending from the circumference of the opposing surface to the circumference of the cutting surface;

bonding the cutting table to a substrate; and forming one or more fins extending from a portion of the cutting surface to a portion of the cutting table outer wall, wherein the cutting surface, the opposing surface, and the cutting table outer wall comprise leached polycrystalline diamond and wherein at least one of said one or more fins has a lower wear resistance than said cutting surface.

30. The method of claim 29, further comprising leaching at least the cutting surface and a portion around the fins.

31. The method of claim 29, wherein the fins are formed after the cutting table is formed.

32. The method of claim 29, wherein the fins are formed during the formation of the cutting table.

33. A cutting table, comprising:

a cutting surface;

an opposing surface;

a cutting table outer wall; and one or more fins extending from a portion of the cutting surface to a portion of the cutting table outer wall, each fin comprising a first side wall and a second side wall positioned opposite the first side wall, both side walls extending from a portion of the cutting surface to a portion of the cutting table outer wall, wherein the first side wall is substantially parallel to the second side wall, and wherein the cutting table comprise leached polycrystalline diamond and wherein at least one of said one or more fins has a lower wear resistance than said cutting surface.

34. The cutting table of claim 33, wherein at least a portion of the cutting surface is leached.

35. The cutting table of claim 33, wherein the fins comprise a metal carbide.

36. A cutter, comprising:

a substrate comprising a top surface;

a cutting table, comprising:

a cutting surface that includes leached polycrystalline diamond;

an opposing surface coupled to the top surface;

a cutting table outer wall extending from the circumference of the opposing surface to the circumference of the cutting surface; and one or more fins extending from a portion of the cutting surface to a portion of the cutting table outer wall, wherein the cutter is a fixed cutter and the substrate is configured to be nonrotatably coupled to a downhole tool and wherein at least one of said one or more fins has a lower wear resistance than said cutting surface.

37. The cutter of claim 36, wherein at least a portion of the cutting surface is leached.

38. The cutter of claim 36, wherein the fins comprise a metal carbide.

39. A cutter, comprising:

a substrate comprising a top surface;

a cutting table, comprising:

a cutting surface;

an opposing surface coupled to the top surface;

a cutting table outer wall extending from the circumference of the opposing surface to the circumference of the cutting surface; and one or more fins extending from a portion of the cutting surface to a portion of the cutting table outer wall, at least one fin extending at least fifty percent of the length of the cutting table outer wall, and wherein the cutting table comprise leached polycrystalline diamond and wherein at least one of said one or more fins has a lower wear resistance than said cutting surface.

40. The cutter of claim 39, wherein at least a portion of the cutting surface is leached.

41. The cutter of claim 39, wherein the fins comprise a metal carbide.

* * * * *

UNITED STATES PATENT AND TRADEMARK OFFICE

CERTIFICATE OF CORRECTION

PATENT NO. : 8,936,115 B2
APPLICATION NO. : 12/862531
DATED : January 20, 2015
INVENTOR(S) : Federico Bellin It is certified that error appears in the above-identified patent and that said Letters Patent is hereby corrected as shown below:

In The Claims

Claim 1, column 17, lines 44 to 45 should appear as follows:

one or more fins extending from the cutting surface to the cutting table outer wall, Signed and Sealed this
Tenth Day of May, 2016

Michelle K. Lee

Michelle K. Lee
*Director of the United States Patent and Trademark Office*